US009808394B1

(12) United States Patent
Jiang

(10) Patent No.: US 9,808,394 B1
(45) Date of Patent: Nov. 7, 2017

(54) FOLDABLE WALKER DEVICE

(71) Applicant: ST. YORK ENTERPRISE CO., LTD., Taichung (TW)

(72) Inventor: Jin Shan Jiang, Taichung (TW)

(73) Assignee: ST. YORK ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 15/241,383

(22) Filed: Aug. 19, 2016

(51) Int. Cl.
*A61H 3/04* (2006.01)
*A47C 4/04* (2006.01)

(52) U.S. Cl.
CPC ..... *A61H 3/04* (2013.01); *A47C 4/04* (2013.01); *A61H 2003/046* (2013.01); *A61H 2201/0161* (2013.01); *A61H 2201/0192* (2013.01); *A61H 2201/1633* (2013.01); *A61H 2201/1635* (2013.01)

(58) Field of Classification Search
CPC ..... A61H 3/04
See application file for complete search history.

(56) References Cited

U.S. PATENT DOCUMENTS 5,224,721 A * 7/1993 Santmann ..... A61H 3/04 135/67
2011/0193305 A1* 8/2011 Li ..... A61H 3/04 280/47.34

* cited by examiner

*Primary Examiner* — John Walters
*Assistant Examiner* — James Triggs
(74) *Attorney, Agent, or Firm* — Guice Patents PLLC

(57) ABSTRACT

A foldable walker device includes a front frame and a rear frame. The front frame and the rear frame are pivotally connected with each other and can be relatively folded and unfolded. A seat board bridged between the front frame and the rear frame. At least one link, a front end of the link is pivotally connected with the seat board, a rear end of the link is pivotally disposed on the rear frame. When folding the walker device, the rear end of the seat board is lifted, whereby the link pivotally connected with the seat board drives the rear frame to move forward and get closer to the front frame. Under such circumstance, the walker device is folded into a minimum volume so as to minimize the room occupied by the walker device. This facilitates the storage and transfer of the walker device.

16 Claims, 10 Drawing Sheets

FOLDABLE WALKER DEVICE

BACKGROUND OF THE INVENTION

1. Field of the Invention

The present invention relates generally to a walker device, and more particularly to a foldable walker device.

2. Description of the Related Art

Along with the advance of the society and the development of medical technique, in recent years, the birth rate and death rate have become lower and lower. The proportion of aged population is greatly increased. The aging society has become a very important and non-negligible topic. The phenomena and problems caused by the aging society have gradually appeared. For example, an aged person often suffers from joint degeneration and physical deterioration and can hardly keep a high mobility and acute sensitivity as a young people. It often takes place that an aged person unexpectedly trips over or falls down when shopping, routinely exercising or even simply normally walking. Due to the aging of the physiological function, in case of a slight trip or fall, an aged person still may suffer from many serious situations such as bone fracture, unstoppable bleeding of the wound or other complications.

In view of the above problems, various walker devices for helping an aged person to walk are commercially available now. An aged person can hold the walker device to more securely and smoothly walk. Even if the aged person is suddenly unsteady on his/her feet, the walker device can immediately serve as an aiding device to support the gravity center of the aged person's body. In this case, the aged person can use the walker device to support and balance his/her own body so as to avoid any dangerous situation such as trip or fall in time. Therefore, the walker device can enhance the security of an aged person in walking.

However, the conventional walker device has a huge volume and always occupies a considerably large room even when a user is lastingly resting or sleeping without using the walker device. This will affect the walking path of others or even narrow the activity region of others. Moreover, when the user goes out for a travel such as a family travel, the huge volume of the walker device also makes the walker device hard to move or transfer. Although the family of the user can help the user to move the walker device, the family still needs to consume much strength for moving the walker device on board. Conclusively, it is uneasy to store or transfer the conventional walker device.

SUMMARY OF THE INVENTION

It is therefore a primary object of the present invention to provide a walker device, which is easily foldable into a minimum volume so as to facilitate the storage and transfer.

It is a further object of the present invention to provide a walker device, which can be easily folded.

To achieve the above and other objects, the foldable walker device of the present invention includes:

a front frame;

a rear frame, a top end of the rear frame being pivotally connected with the front frame, whereby the front frame and the rear frame can be relatively folded and unfolded;

a handlebar frame disposed between the front frame and the rear frame and vertically movable;

a seat board having a front end, a rear end and a pivoted section disposed between the front and rear ends of the seat board, the seat board being bridged between the front frame and the rear frame, the front end of the seat board being pivotally connected with the front frame, the rear end of the seat board being detachably connected with the rear frame; and at least one link, a front end of the link being pivotally connected with the pivoted section of the seat board, a rear end of the link being pivotally disposed on the rear frame.

According to the above arrangement, when the rear end of the seat board of the walker device is lifted, the link pivotally connected with the pivoted section of the seat board drives the rear frame to move toward the front frame. Accordingly, the walker device can be quickly and conveniently folded to minimize the room occupied by the walker device. Under such circumstance, the storage and transfer of the walker device are facilitated.

The present invention can be best understood through the following description and accompanying drawings, wherein:

DETAILED DESCRIPTION OF THE PREFERRED EMBODIMENTS

Figure 1:
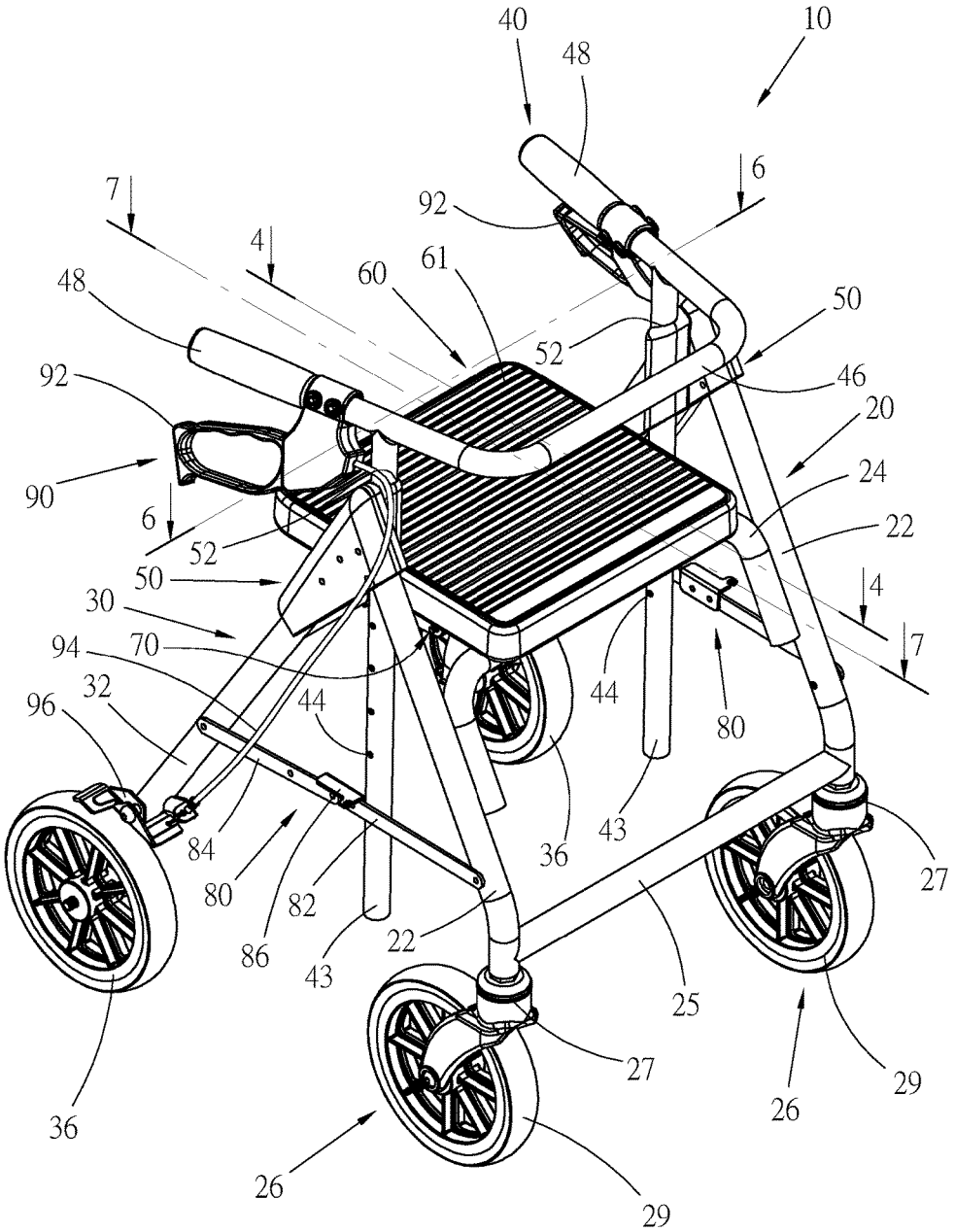
FIG. 1 is a front perspective view of a preferred embodiment of the foldable walker device of the present invention in an unfolded state.
Figure 2:
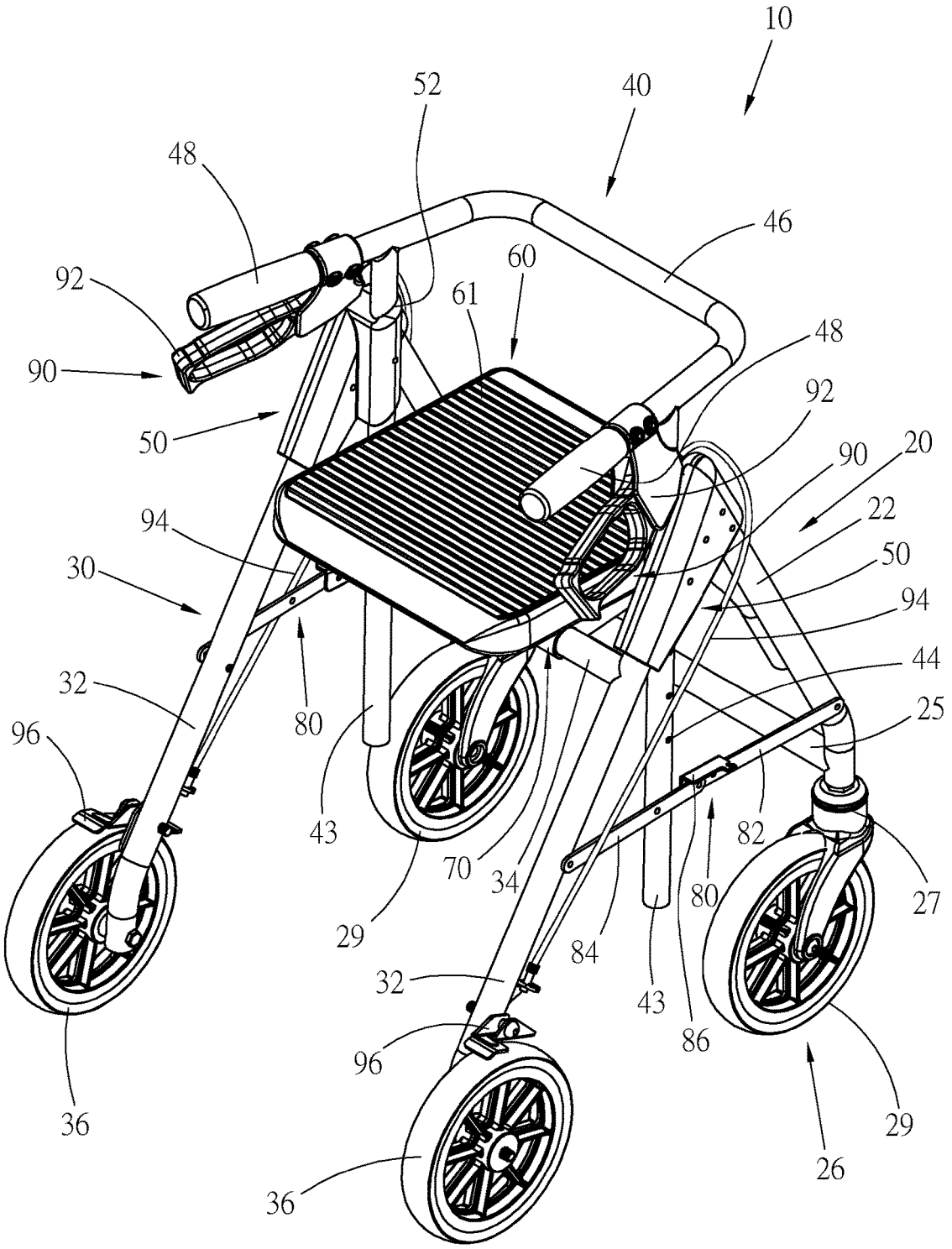
FIG. 2 is a rear perspective view of the foldable walker device of the present invention according to FIG. 1.
Figure 3:
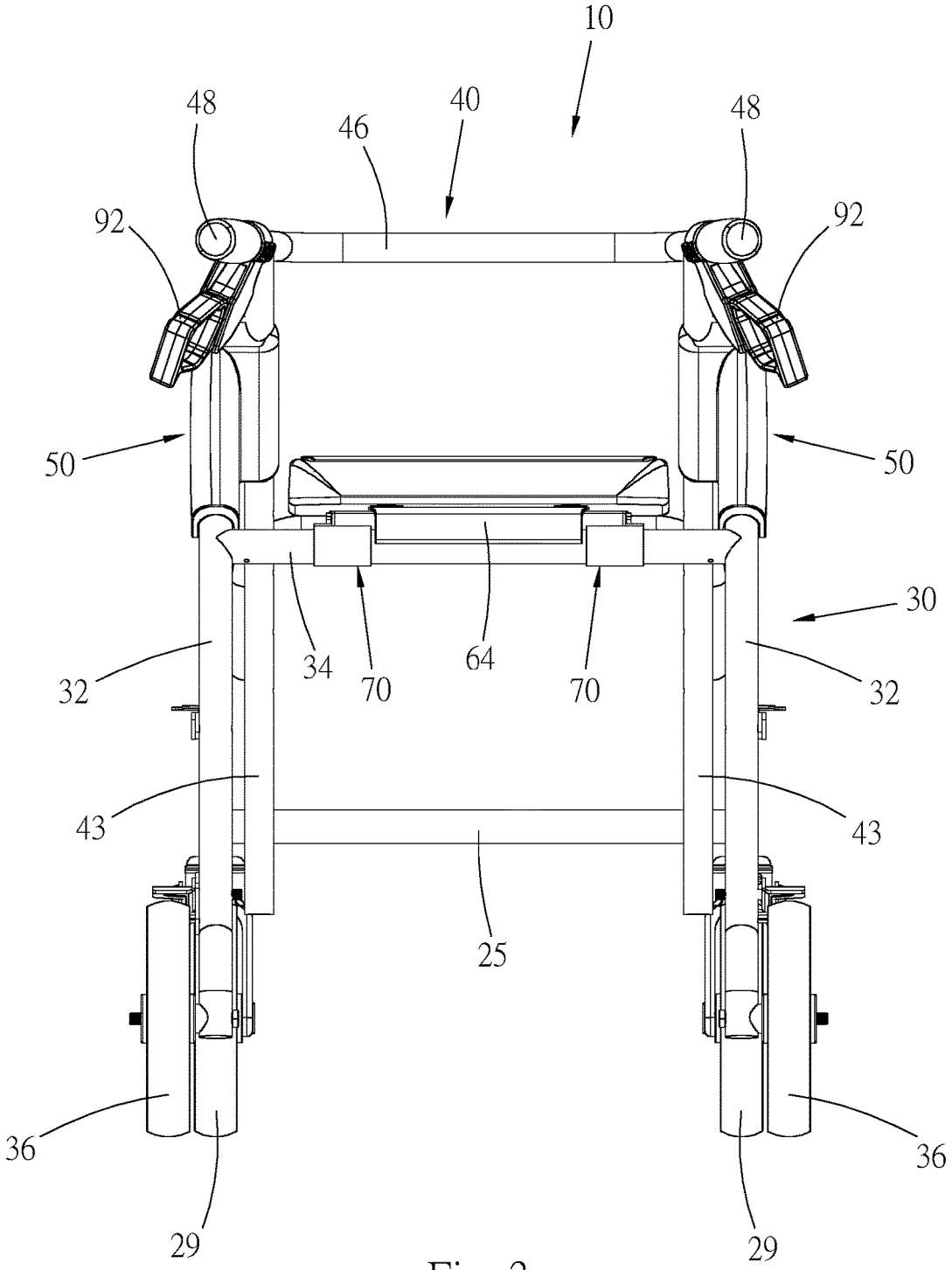
FIG. 3 is a rear view of the foldable walker device of the present invention according to FIG. 1.

Please refer to FIGS. 1 to 3. According to a preferred embodiment, the foldable walker device 10 of the present invention includes a front frame 20, a rear frame 30, a handlebar frame 40, two connection members 50, a seat board 60, at least one link 70, two folding bar assemblies 80 and two brake mechanisms 90.

The front frame 20 includes two front lateral legs 22, at least one transverse bar and two front wheel assemblies 26. In this embodiment, there are an upper transverse bar 24 and a lower transverse bar 25. The two front lateral legs 22 are arranged in parallel to each other. The upper and lower transverse bars 24, 25 are transversely connected between the two front lateral legs 22. The upper transverse bar 24 is positioned above the lower transverse bar 25. Each of the front wheel assemblies 26 includes a wheel support 27 and at least one front wheel 29. The two wheel supports 27 are respectively rotatably pivotally connected with bottom ends of the front lateral legs 22. Each of the front wheel assemblies 26 includes a front wheel 29 or two front wheels 29 arranged side by side. In this embodiment, each of the front wheel assemblies 26 includes a front wheel 29. The two front wheels 29 are respectively pivotally connected with the wheel supports 27.

The rear frame 30 includes two rear lateral legs 32, a bracket bar 34 and two rear wheels 36. The two rear lateral legs 32 are arranged in parallel to each other. The bracket bar 34 is transversely connected between the two rear lateral legs 32. The two rear wheels 36 are respectively pivotally connected with bottom ends of the rear lateral legs 32. The rear frame 30 is positioned behind the front frame 20.

The handlebar frame 40 includes two upright columns 43 and aback bar 46. The two upright columns 43 are arranged in parallel to each other. Multiple insertion holes 44 are formed on outer surfaces of the upright columns 43 and arranged in a longitudinal direction of the upright columns 43. The two upright columns 43 are respectively disposed between the front lateral legs 22 of the front frame 20 and the rear lateral legs 32 of the rear frame 30. The back bar 46 is substantially U-shaped. Two ends of the back bar 46 are formed with two handles 48. The back bar 46 is disposed at top ends of the two upright columns 43.

Figure 6:
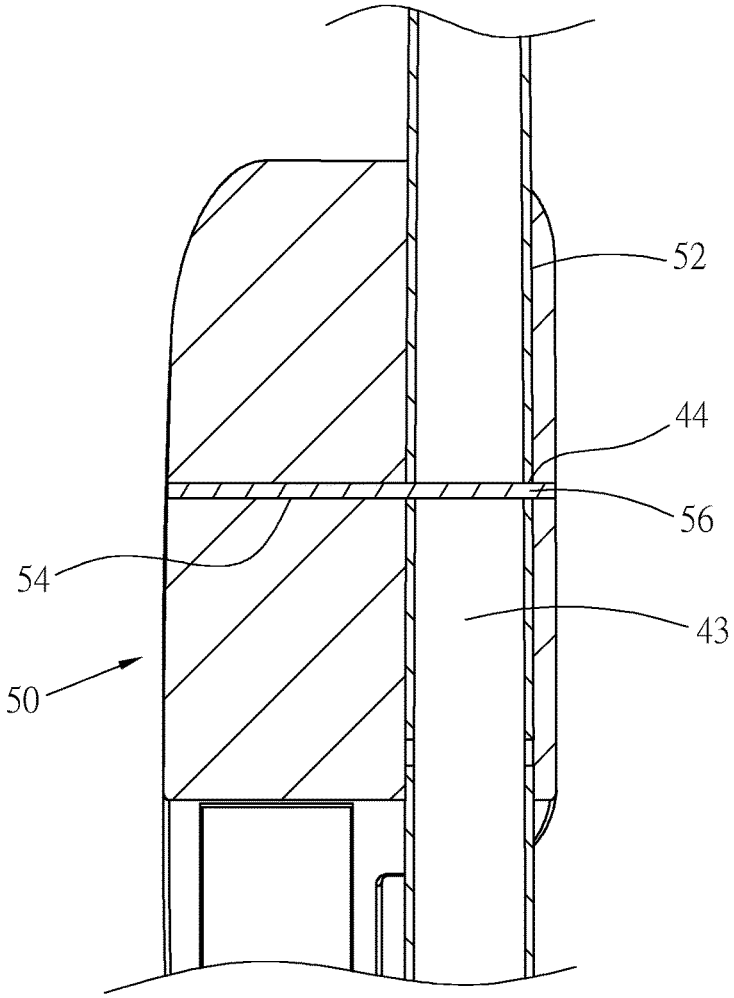
FIG. 6 is an enlarged sectional view taken along line 6-6 of FIG. 1, showing a part of the foldable walker device of the present invention.
Figure 5:
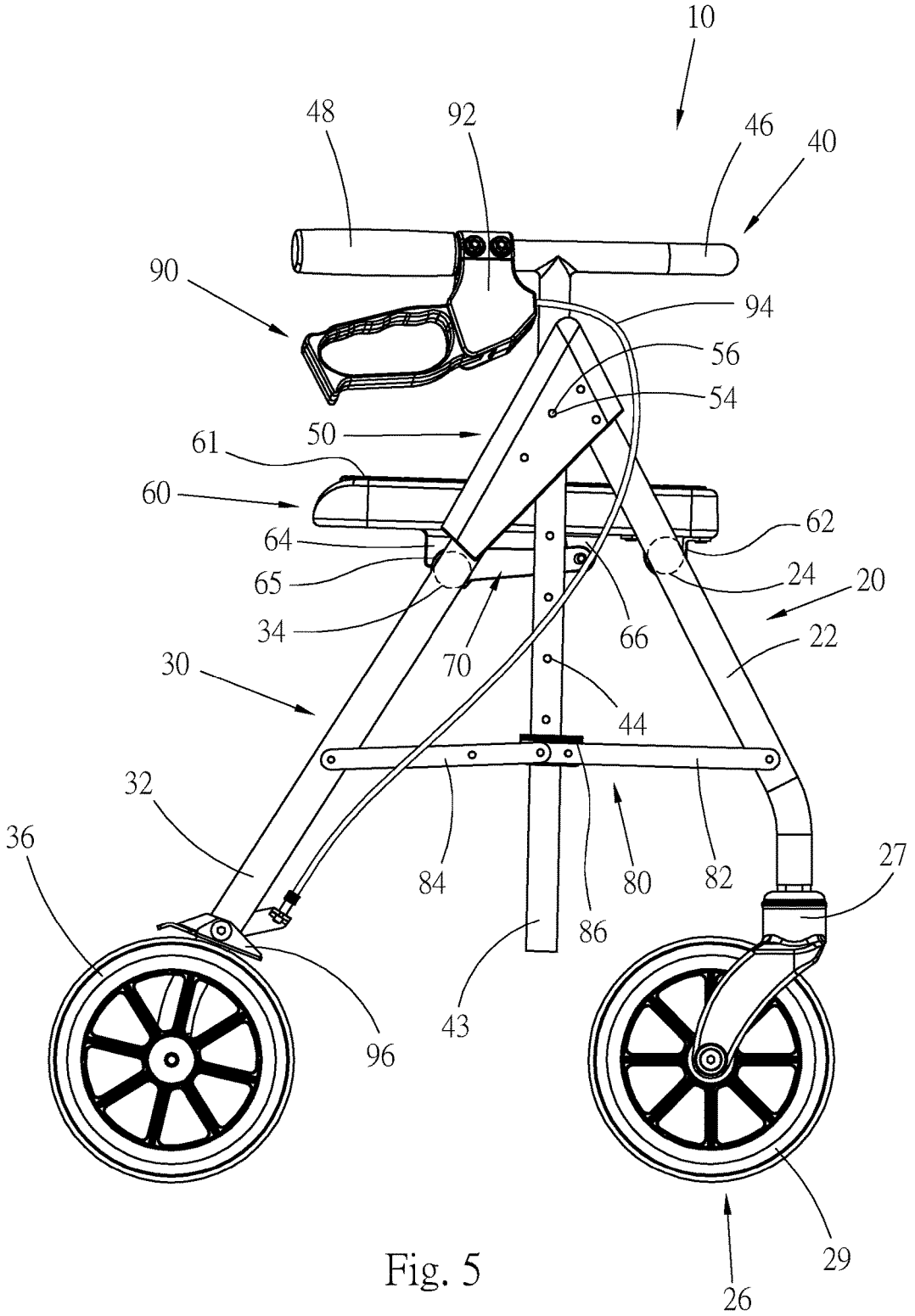
FIG. 5 is a side view of the foldable walker device of the present invention according to FIG. 1.

Please refer to FIGS. 1, 5 and 6. Each of the connection members 50 has a passage 52 and a through hole 54 in communication with the passage 52. The two connection members 50 are respectively positioned on left and right sides of the front frame 20 and the rear frame 30 and disposed between the front frame 20, the rear frame 30 and the handlebar frame 40. The top ends of the two front lateral legs 22 of the front frame 20 are respectively fixedly connected with the connection members 50. The top ends of the two rear lateral legs 32 of the rear frame 30 are respectively pivotally connected with the connection members 50. With the pivoted section serving as the rotational center, the two rear lateral legs 32 and the front lateral legs 22 of the front frame 20 can be moved to get closer to each other or away from each other. The two upright columns 43 of the handlebar frame 40 are respectively inserted in the passages 52 of the connection members 50 and movable within the passages 52 to adjust the height of the handlebar frame 40. Two insertion members 56, which can be pins, screws or elastic latch members, are respectively inserted or latched in the through holes 54 of the connection members 50 and the insertion holes 44 of the upright columns 43 so as to securely connect the upright columns 43 with the connection members 50 and fix the handlebar frame 40 at a certain height.

Figure 4:
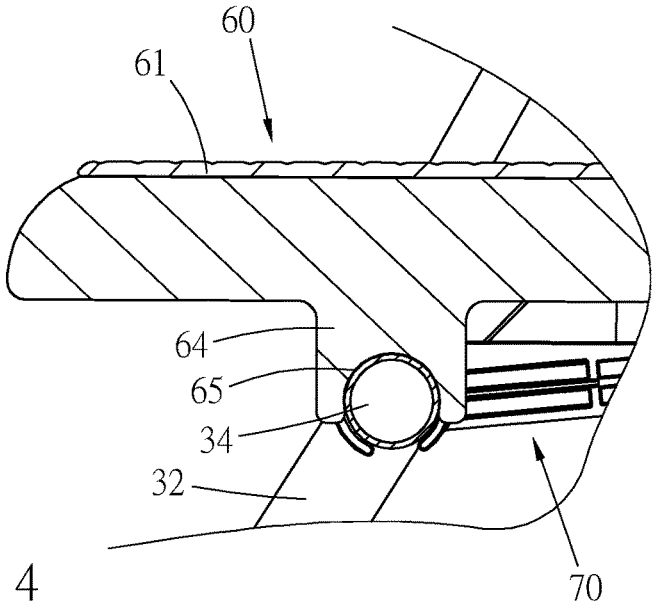
FIG. 4 is an enlarged sectional view taken along line 4-4 of FIG. 1, showing a part of the foldable walker device of the present invention.

Please refer to FIGS. 3 to 5. The seat board 60 has an antislip face 61, a front end, a rear end and a pivoted section 66. The antislip face 61 is disposed on a top face of the seat board 60. The pivoted section 66 is disposed on the bottom face of the seat board 60 and positioned between the front and rear ends of the seat board 60. The seat board 60 is bridged between the upper transverse bar 24 of the front frame 20 and the bracket bar 34 of the rear frame 30. The front end of the seat board 60 is pivotally connected with the upper transverse bar 24 of the front frame 20 via a pivot member 62. The rear end of the seat board 60 has an engagement section 64. A bottom face of the engagement section 64 is formed with an engagement notch 65. The bracket bar 34 of the rear frame 30 is detachably latched in the engagement notch 65 of the engagement section 64.

Please further refer to FIGS. 3 to 5. In this embodiment, there are two links 70 in parallel to each other. The front ends of the links 70 are pivotally connected with the pivoted section 66 of the seat board 60. The rear ends of the links 70 are pivotally connected with the bracket bar 34 of the rear frame 30. When the rear end of the seat board 60 is lifted, the two links 70 drive the rear frame 30 to move toward the front frame 20.

Each of the folding bar assemblies 80 has a first folding bar 82, a second folding bar 84 and an abutment member 86. An inner end of the first folding bar 82 is pivotally connected with an inner end of the second folding bar 84. An outer end of the first folding bar 82 is pivotally connected with the front lateral leg 22 of the front frame 20. An outer end of the second folding bar 84 is pivotally connected with the rear lateral leg 32 of the rear frame 30. The abutment member 86 is disposed at the inner end of the first folding bar 82. When the folding bar assembly 80 is unfolded, the abutment member 86 abuts against the second folding bar 84.

Each of the brake mechanisms 90 has a brake handle 92, a brake cable 94 and a stopper member 96. The brake handle 92 is mounted on the handle 48 of the handlebar frame 40. The stopper member 96 is mounted at the bottom end of the rear lateral leg 32 of the rear frame 30 for compressing or releasing the rear wheel 36. The brake cable 94 is connected between the brake handle 92 and the stopper member 96, whereby the brake handle 92 can control the stopper member 96 to compress or release the rear wheel 36. The brake mechanism does not pertain to the subject matter of the present invention and thus will not be further described.

Please further refer to FIG. 5. Before a user uses the walker device 10 of the present invention, the height of the handlebar frame 40 can be first adjusted according to the height of the user. In this case, the user can more easily hold the handles 48 of the handlebar frame 40. When the user uses the walker device 10 to help in walking, the user's hands respectively hold the handles 48 of the handlebar frame 40, whereby the walker device 10 can support the gravity center of the user's body. Moreover, when walking, the two front wheels 29 and the two rear wheels 36 will rotate by a speed in accordance with the walking speed of the user. Furthermore, the two front wheels 29 can swivel in the walking direction of the user. In this case, the user can easily and freely walk with the walker device 10. Also, the user can use the two brake mechanisms 90 to decelerate the two rear wheels 36 so as to slowdown the walker device 10. This enhances the security in use of the walker device 10.

When the user desires to take a rest, the user can sit on the seat board 60 of the walker device 10 and lean on the back bar 46. The antislip face 61 on the top face of the seat board 60 serves to prevent the user from slipping down from the seat board 60. The back bar 46 is U-shaped so that the user is protected from laterally falling down.

Figure 7:
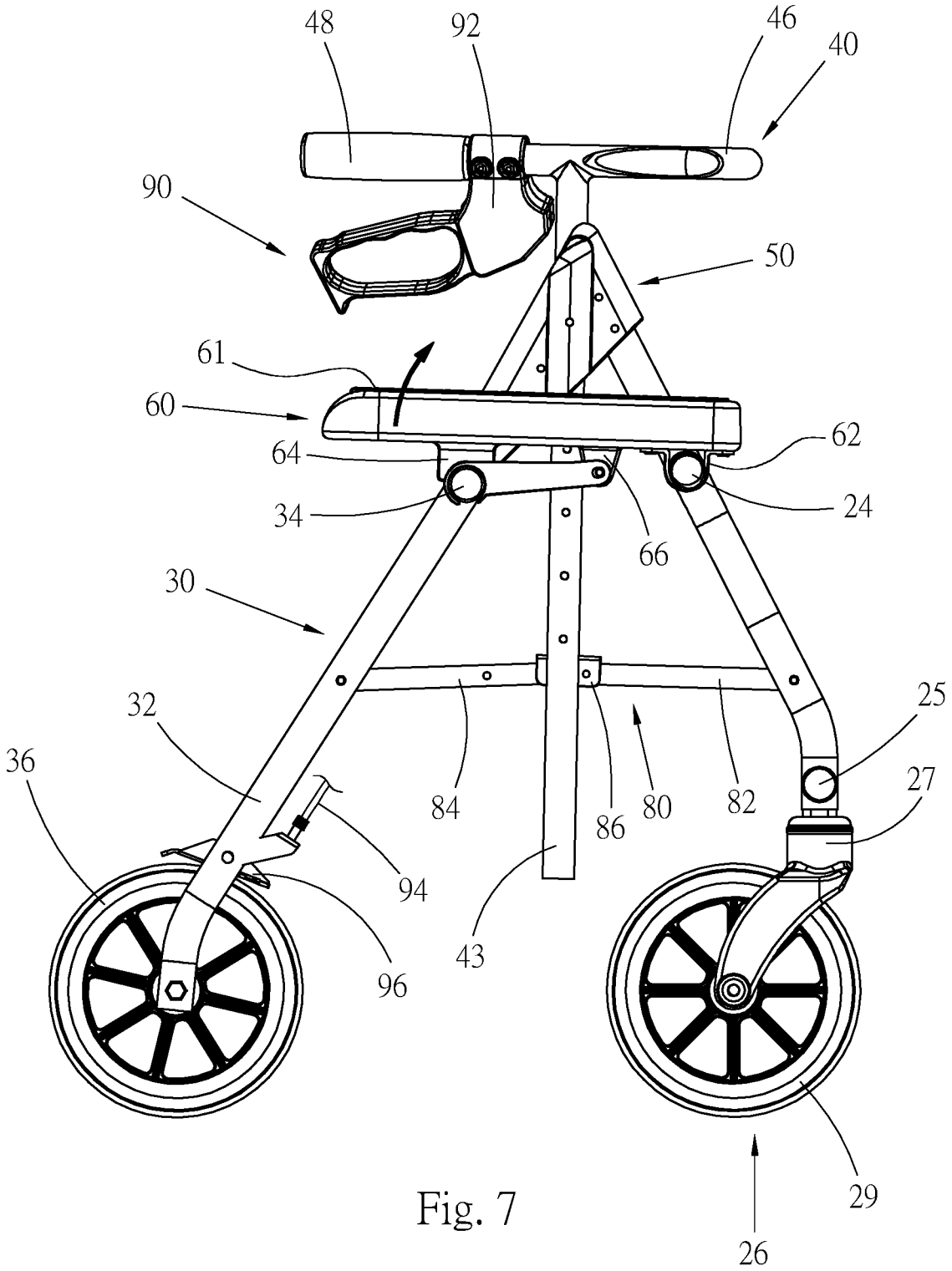
FIG. 7 is a sectional view taken along line 7-7 of FIG. 1.
Figure 8:
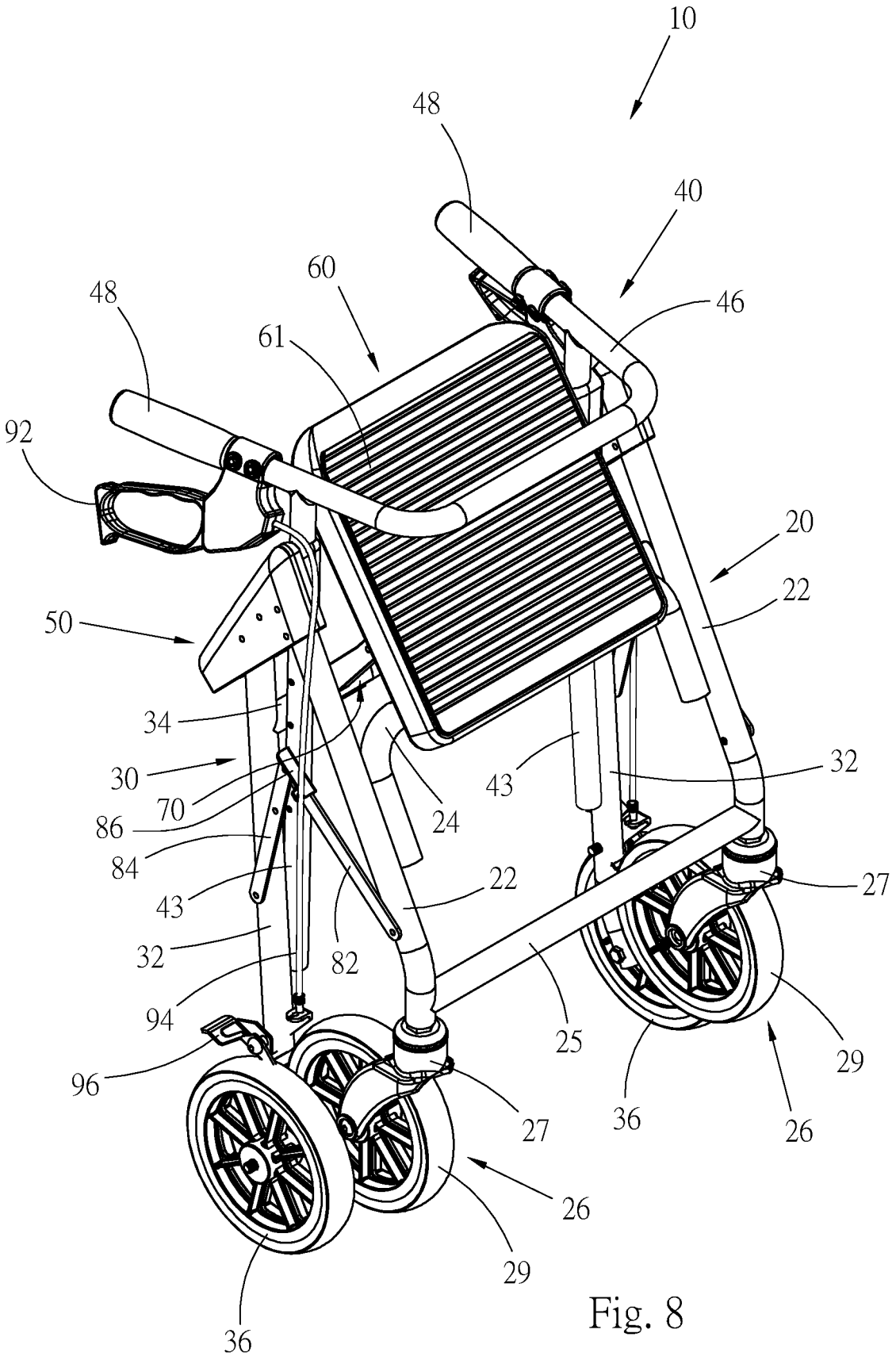
FIG. 8 is a front perspective view of the foldable walker device of the present invention according to FIG. 1 in a folded state.
Figure 9:
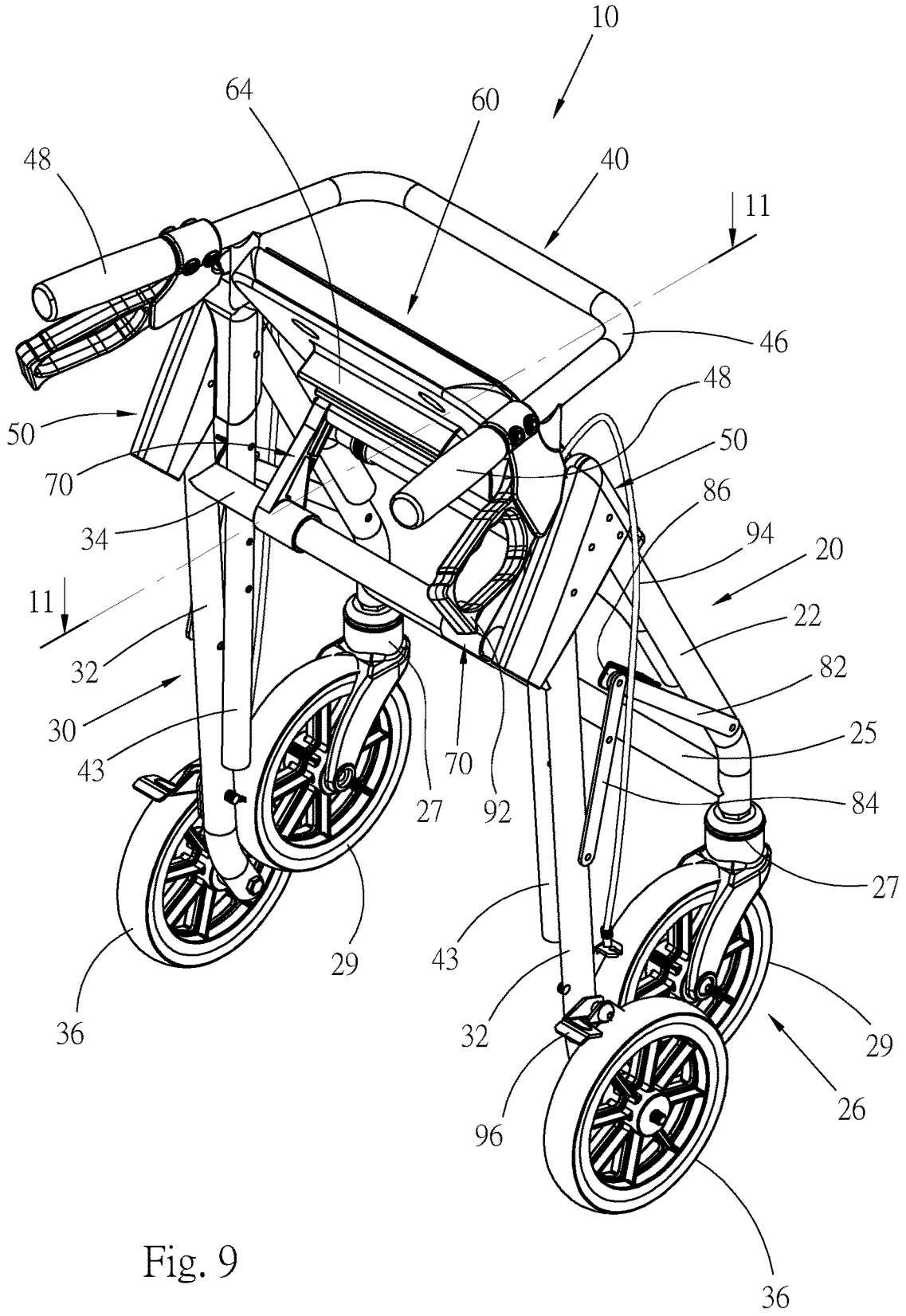
FIG. 9 is a rear perspective view of the foldable walker device of the present invention according to FIG. 8.
Figure 10:
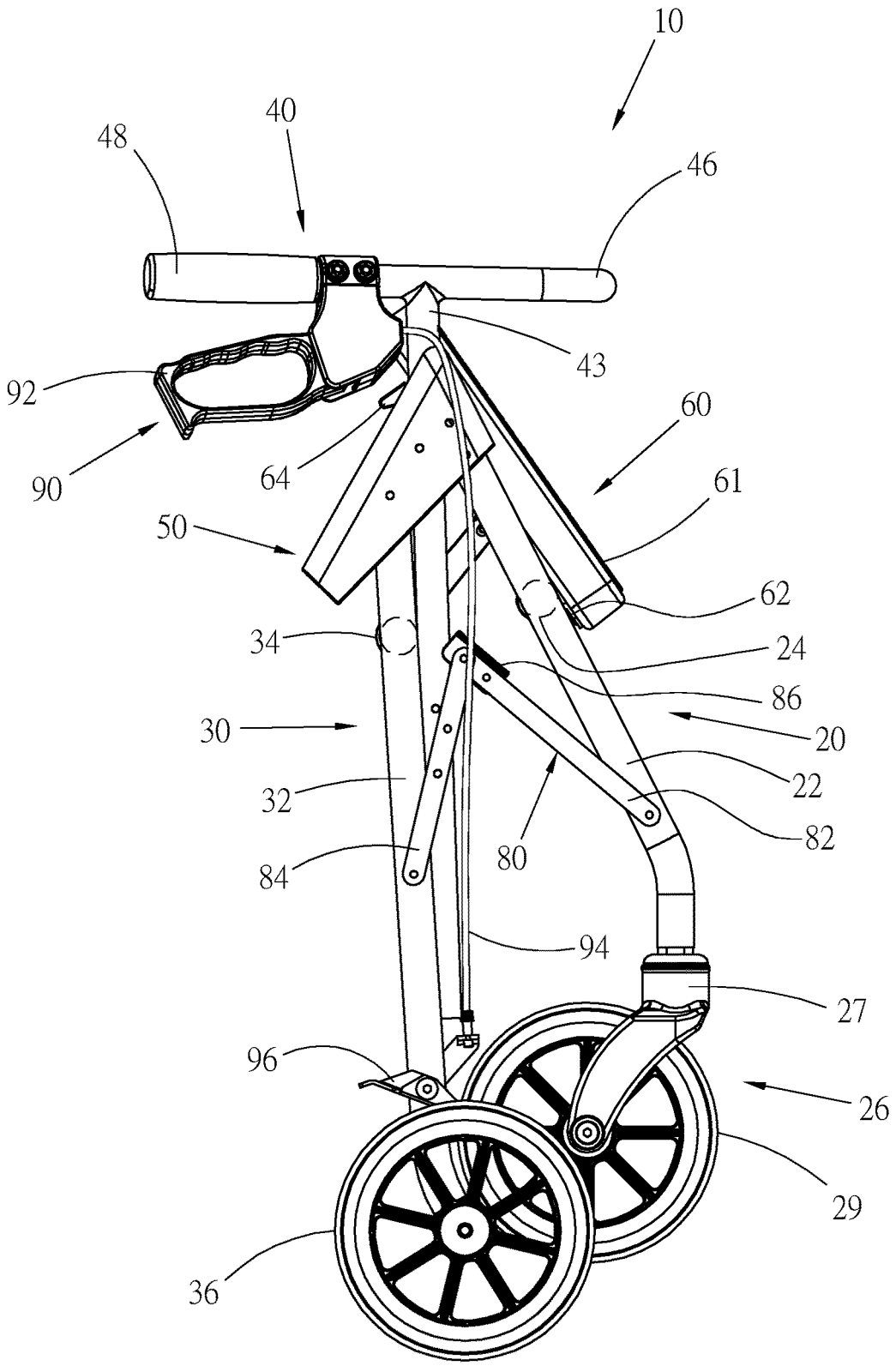
FIG. 10 is a side view of the foldable walker device of the present invention according to FIG. 8.

Please refer to FIGS. 5 and 7. After the use of the walker device 10 and when it is desired to store or transfer the walker device 10, the rear end of the seat board 60 is lifted to separate the engagement notch 65 of the engagement section 64 from the bracket bar 34 of the rear frame 30. When the rear end of the seat board 60 is lifted, the two links 70 pivotally connected with the pivoted section 66 of the seat board 60 are angularly moved along with the seat board 60 to pull the rear frame 30 to move toward the front frame 20. At this time, the two first folding bars 82 and the two second folding bars 84 of the two folding bar assemblies 80 are also folded up. Please refer to FIGS. 8 to 11. When the two rear lateral legs 32 abut against the two front wheels 29, the front frame 20 and the rear frame 30 are closest to each other. Under such circumstance, the walker device 10 is folded into a minimum volume so as to minimize the room occupied by the walker device 10.

Figure 11:
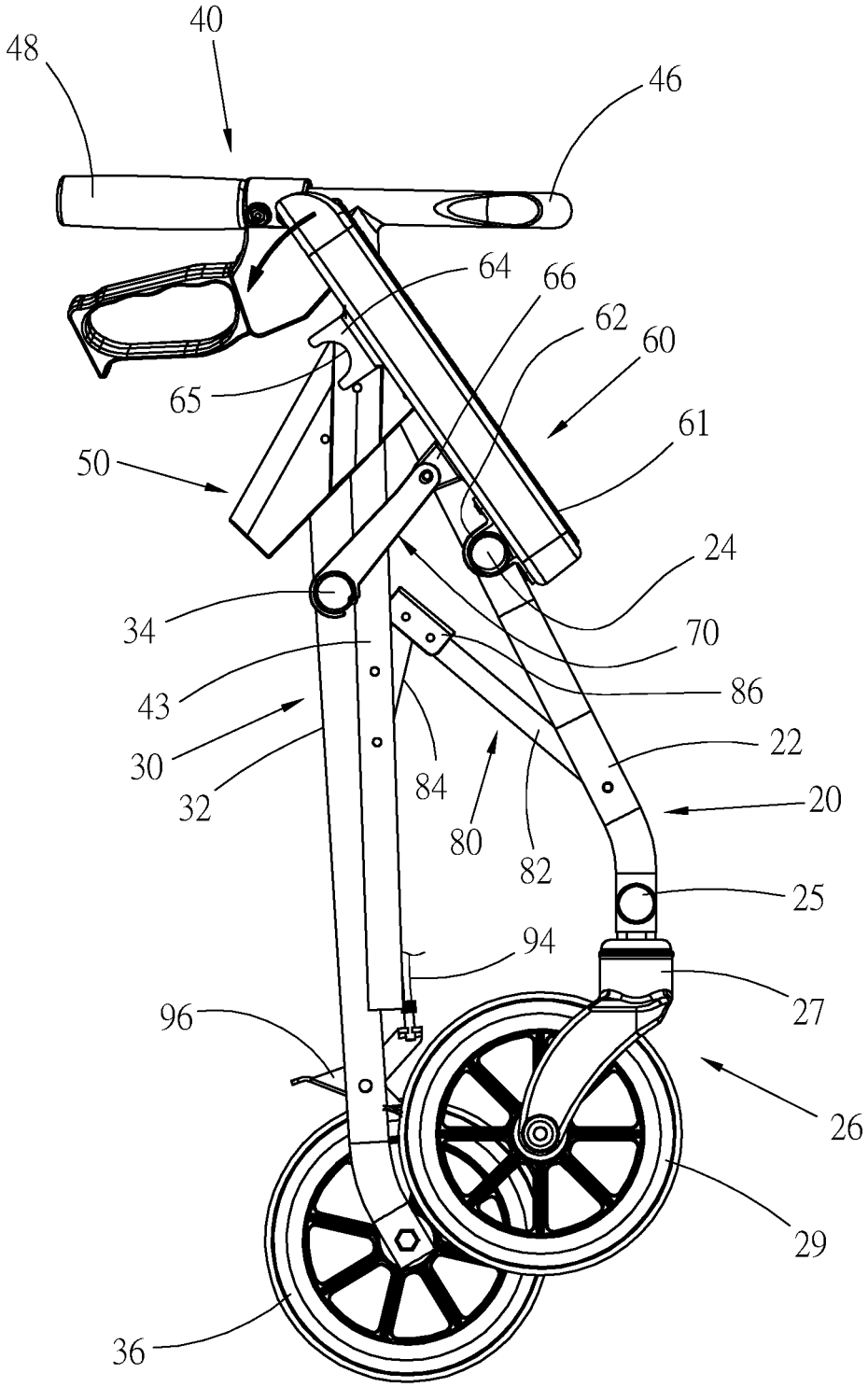
FIG. 11 is a sectional view taken along line 11-11 of FIG. 9.

Please further refer to FIG. 11. When it is desired to use the walker device 10 again, the user only needs to press down the rear end of the seat board 60. At this time, the two links 70 will push the rear frame 30 backward along with the seat board 60, whereby the rear frame 30 is moved away from the front frame 20. Also, the two first folding bars 82 and the two second folding bars 84 of the two folding bar assemblies 80 are unfolded along with the separation between the front frame 20 and the rear frame 30. When the bracket bar 34 of the rear frame 30 is engaged into the engagement notch 65 of the seat board 60, the walker device 10 is fully unfolded. Under such circumstance, the user can use the walker device 10 to help in walking again.

The height of the handles of the walker device of the present invention is adjustable according to the height of a user. Moreover, when walking, the two front wheels can swivel in the walking direction of the user. Also, in case of over-speeding, the user can use the two brake mechanisms to decelerate the walker device. Therefore, not only the user can easily and freely walk with the walker device, but also the safety of the user is ensured. Furthermore, the walker device of the present invention can be quickly and easily folded only by means of lifting or lowering the rear end of the seat board. After folded, the volume of the walker device is minimized and the room occupied by the walker device is reduced so that the walker device can be easily stored. Also, when a user travels with the walker device, the walker device can be folded to facilitate the transfer of the walker device. Accordingly, the user can easily transfer the walker device without consuming too much strength so that the convenience in use of the walker device is enhanced.

The above embodiments are only used to illustrate the present invention, not intended to limit the scope thereof. Many modifications of the above embodiments can be made without departing from the spirit of the present invention.

What is claimed is:

1. A foldable walker device comprising:

a front frame;

a rear frame, a top end of the rear frame being pivotally connected with the front frame, whereby the front frame and the rear frame is relatively folded and unfolded;

a handlebar frame disposed between the front frame and the rear frame;

a seat board having a front end, a rear end and a pivoted section disposed between the front and rear ends of the seat board, the seat board being bridged between the front frame and the rear frame, the front end of the seat board being pivotally connected with the front frame, the rear end of the seat board being detachably connected with the rear frame; and at least one link, a front end of the link being pivotally connected with the pivoted section of the seat board, a rear end of the link being pivotally disposed on the rear frame;

wherein the rear frame includes two rear lateral legs and a bracket bar transversely connected between the two rear lateral legs, the rear end of the seat board having an engagement section detachably engaged with the bracket bar, the rear end of the link being pivotally connected with the bracket bar.

2. The foldable walker device as claimed in claim 1, wherein the front frame includes two front lateral legs and a transverse bar transversely connected between the two front lateral legs, the front end of the seat board being pivotally connected with the transverse bar.

3. A foldable walker device comprising:

a front frame;

a rear frame, a top end of the rear frame being pivotally connected with the front frame, whereby the front frame and the rear frame is relatively folded and unfolded;

a handlebar frame disposed between the front frame and the rear frame;

a seat board having a front end, a rear end and a pivoted section disposed between the front and rear ends of the seat board, the seat board being bridged between the front frame and the rear frame, the front end of the seat board being pivotally connected with the front frame, the rear end of the seat board being detachably connected with the rear frame; and at least one link, a front end of the link being pivotally connected with the pivoted section of the seat board, a rear end of the link being pivotally disposed on the rear frame;

wherein the handlebar frame includes two upright columns and a back bar, the two upright columns being disposed between the front frame and the rear frame and vertically movable to adjust the height, the back bar being substantially U-shaped, two ends of the back bar being formed with two handles, the back bar being disposed at top ends of the two upright columns.

4. The foldable walker device as claimed in claim 1, further comprising two connection members disposed between the front frame and the rear frame, the top end of the front frame being fixedly connected with the connection members, the top end of the rear frame being pivotally connected with the connection members, the handlebar frame being detachably disposed on the connection members.

5. The foldable walker device as claimed in claim 2, further comprising two connection members disposed between the front frame and the rear frame, the top end of the front frame being fixedly connected with the connection members, the top end of the rear frame being pivotally connected with the connection members, the handlebar frame being detachably disposed on the connection members.

6. The foldable walker device as claimed in claim 3, further comprising two connection members disposed between the front frame and the rear frame, the top end of the front frame being fixedly connected with the connection members, the top end of the rear frame being pivotally connected with the connection members, the handlebar frame being detachably disposed on the connection members.

7. The foldable walker device as claimed in claim 1, wherein the pivoted section of the seat board is disposed on a bottom face of the seat board.

8. The foldable walker device as claimed in claim 2, wherein the pivoted section of the seat board is disposed on a bottom face of the seat board.

9. The foldable walker device as claimed in claim 3, wherein the pivoted section of the seat board is disposed on a bottom face of the seat board.

10. The foldable walker device as claimed in claim 1, wherein the seat board further includes a pivot member, the pivot member being disposed at the front end of the seat board and pivotally connected with the front frame.

11. The foldable walker device as claimed in claim 2, wherein the seat board further includes a pivot member, the pivot member being disposed at the front end of the seat board and pivotally connected with the front frame.

12. The foldable walker device as claimed in claim 3, wherein the seat board further includes a pivot member, the pivot member being disposed at the front end of the seat board and pivotally connected with the front frame.

13. The foldable walker device as claimed in claim 1, wherein the rear frame further includes a bracket bar, the engagement section of the seat board having an engagement notch formed on the bottom face of the engagement section, the bracket bar of the rear frame being detachably latched in the engagement notch.

14. The foldable walker device as claimed in claim 2, wherein the rear frame further includes a bracket bar, the engagement section of the seat board having an engagement notch formed on the bottom face of the engagement section, the bracket bar of the rear frame being detachably latched in the engagement notch.

15. The foldable walker device as claimed in claim 4, wherein the handlebar frame further includes two upright columns, multiple insertion holes being formed on the upright columns and arranged in a longitudinal direction of the upright columns, each of the connection members having a passage, a through hole and an insertion member, the passage vertically extending and communicating with the through hole, the two upright columns of the handlebar frame being respectively inserted in the passages of the connection members, the two insertion members being respectively inserted in the through holes of the connection members and one of the insertion holes of each of the upright columns.

16. The foldable walker device as claimed in claim 1, further comprising two front wheel assemblies and two rear wheels, each of the front wheel assemblies including a wheel support and at least one front wheel, the two wheel supports being respectively pivotally connected with the bottom end of the front frame, the two front wheels being pivotally connected with the wheel supports, the two rear wheels being disposed at the bottom end of the rear frame.

* * * * *